United States Patent [19]

Abe

[11] 4,358,317

[45] Nov. 9, 1982

[54] MATERIALS FOR A BIT

[75] Inventor: Yoshihiko Abe, Tokyo, Japan

[73] Assignee: Mitsubishi Steel Mfg. Co., Ltd., Tokyo, Japan

[21] Appl. No.: 214,420

[22] Filed: Dec. 8, 1980

[30] Foreign Application Priority Data

May 12, 1980 [JP] Japan ..... 55-61706

[51] Int. Cl.[3] ..... C22C 38/22; C22C 38/24

[52] U.S. Cl. ..... 75/126.C; 75/126 E; 148/36

[58] Field of Search ..... 75/126.C, 126 E; 148/36

[56] References Cited

U.S. PATENT DOCUMENTS

| | | | |
|---|---|---|---|
| 2,793,947 | 5/1957 | Swanson | 75/126 E |
| 2,798,805 | 7/1957 | Hodge et al. | 75/126 E |
| 2,858,206 | 10/1958 | Boyce et al. | 75/126 E |
| 3,272,622 | 9/1966 | Bengtsson | 75/126 E |

OTHER PUBLICATIONS

Neilson, et al., Geothermal Drill Bit Improvement–Specific Application to the Geysers, *Journal of Pressure Vessel Technology,* Transactions of the ASME, Manuscript received at ASME Headquarters, Jun. 27, 1977.

*Primary Examiner*—W. Stallard
*Attorney, Agent, or Firm*—Amster, Rothstein & Engelberg

[57] ABSTRACT

As a material for bit legs, cutters, bearings and ring seals in a bit for drilling igneous rock steel is used which consists essentially in weight % of:

0.10 to 0.20 C;
up to 0.5 Si;
up to 1.0 Mn;
3.0 to 5.0 Cr;
0.8 to 2.0 Mo;
0.10 to 0.70 V; and
the balance being Fe, and is used after its surface layer is hardened by a carburizing process.

1 Claim, 4 Drawing Figures

MATERIALS FOR A BIT

BACKGROUND OF THE INVENTION

The present invention relates to a material for bits and more particularly to a material for bits such as used for drilling igneous rock in a high temperature geothermal formation.

Since bits such as used for drilling a geothermal well and the like must be able to resist wear, impact and temperature, hitherto carburizing steel, such as classified under the appellations SAE 4815, 8720, 4620 and 9310, etc. has been widely used after subjection to a carburizing treatment. However, these carburizing steels have such defects as that they do not exhibit sufficient resistivity to wear such as caused by heavy contact with rocks during the drilling, penetration of debris from the rocks being excavated into the bearing means of the bit, etc., and their resistivity to wear remarkably deteriorates at an elevated temperature of 150° C. or thereabouts since they easily soften at that temperature. Further, in an insert type bit, when it is used for a heavy drilling operation accompanying a temperature rise, or in a well in an environment where the temperature in the well is 200° C. or more, as in a geothermal well, since the cutter blade of the bit of this type which is made of hard metal is subjected to strong impacts, a twisting action, a bending action, etc. during the drilling, not only do slackening and bending of the cutter blade occur, but also in extreme cases, the cutter blade may fall out, and soon, so that the life of the bit shortened.

SUMMARY OF THE INVENTION

It is a primary object of the present invention to provide a material for bits which can eliminate the above defects of the conventional bit material.

It is another object of the present invention to provide a material for bits which easily gives a hardened layer having hardness at least the same as that of a carburized layer of the conventional bit material, i.e. carburizing steel, as well as heat resistivity up to 400° C. and which has a core hardness above 350 on the Vickers scale, this hardness level being not decreased even if its temperature is elevated to as high as 400° C.

In accordance with the present invention a material for bits is provided wherein in order to make the material itself easily carburized for the purpose of giving it a hardened layer economically, and in order to give it also strength, excellent heat resistivity, and good weldability, a steel containing chemical compositions in a specific ratio is selected, i.e. a steel consisting essentially of 0.10 to 0.20 wt% C, up to 0.5 wt% of Si, up to 1.0 wt% Mn, 3.0 to 5.0 wt% Cr, 0.80 to 2.0 wt% Mo, 0.10 to 0.70 wt% V, the balance being Fe.

BRIEF DESCRIPTION OF THE DRAWINGS

These and other objects of the present invention will become more readily apparent upon reading the following specification and upon reference to the accompanying drawings, in which.

DESCRIPTION OF THE PREFERRED EMBODIMENT

Figure 1:
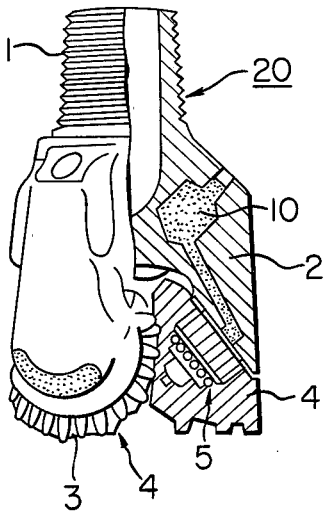
FIG. 1 is a front elevational view showing an example of a bit, partially in section.
Figure 2:
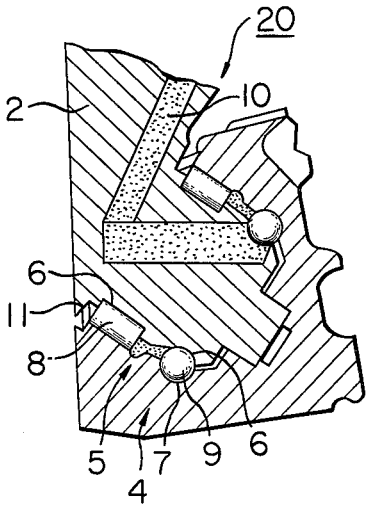
FIG. 2 is a sectional view of a portion of the bit shown in FIG. 1 in an enlarged scale.

FIGS. 1 and 2 show, as one example of a bit to which the material according to the present invention is to be applied, a conical bit having three cutters. As shown in these drawings, the bit 20 comprises a digging cutter bit leg 2 which has a shank 1 at this upper part, by means of which bit leg 2 is adapted to be mounted to the lower end of a rotary drilling pipe not shown. Rotatably mounted by bearings 5 at the lower part of bit leg 2 are three cutters 4, each peripherally provided with cutting teeth 3, so that when bit 30 is moved downwards while rotating, together with the rotary drilling pipe, the cutters 4 rotate, whereby cutting teeth 3 carried by each of cutters 4 divide the rocks or sands. Although in FIGS. 1 and 2 cutting tooth 3 is shown as being integrally formed with cutter 4 made of steel, it may be separately made of hard metal such as tungalloy to be embedded in the cone of the cutter 4 so as to constitute an insert type cutter. As shown in FIG. 2, a portion of bit leg 2 is made to provide an inner race 6 of bearing 5, the inside of cutter 4 being made to provide an outer race 7 of bearing 5. In order to cause cutter 4 to rotate well, bearing 5 interposed between cutters 4 and bit leg 2 are formed as a combined bearing comprising a series of rollers 8 and a series of balls 9. Additionally, disposed between bit leg 2 and cutters 4 are ring seals 11 for the purpose of protecting lubricant 10 for bearing 5 as well as preventing bearing 5 from coming into contact with the fluid within the well.

The bit material according to the present invention has been developed with the aim of using it as the material for bit leg 2, cutter 4, bearing 5, ring seal 11, etc.

Now the reasons why in the material according to the present invention the chemical composition was selected so as to respectively fall under the specific ranges as above mentioned will be fully explained:

C: In order to assure good weldability as well as to obtain the desired Vickers hardness of the core of 350 to 450 after carburizing, quenching and annealing, C of above 0.10 wt% is necessary, but its maximum content must be limited to 0.20 wt%.

Si: Although Si is necessary for manufacturing a sound steel ingot, on the other hand it causes carburization, in particular intergranular oxidation, deteriorating remarkably the anti-impact characteristic, so its upper limit should be 0.5 wt%.

Mn: In order to manufacture an imperfection free ingot as well as to reduce the mass effect at the time of heat treatment and ensure a uniform hardness level of 350 or above on the Vickers scale even in large bits, and to suppress as far as possible the occurrence of ferrites, it is necessary that a maximum of 1.0 wt% of Mn be added.

Cr: In order to ensure a hardness level above that of the hardened layer in conventional steel and also to maintain heat resistivity up to 400° C., a minimum 3.0% of Cr is required, taking into consideration the effects of Mo and V. However, since if its content exceeds 5.0 wt% the hardness of the hardened layer is increased, impairing weldability and decreasing the depth of the hardened layer, it is desirable to limit it to below 5.0 wt%.

Mo: Mo is effective in assuring toughness as well as heat resistivity of the carburized layer and hardness as well as heat resistivity of the core, and this effect begins to be revealed with an addition of 0.8 wt%, but shows no marked fluctuations above 2.0 wt%.

V: V is effective in increasing the hardness as well as the resistivity to softening of the carburized layer, this effect being revealed with an addition of 0.10 wt%, but an addition above 0.70 wt% is excessive.

The reasons why the respective chemical components and their ranges were thus selected in the present invention having been explained above, now the present invention will be described in reference to its embodiments.

As an embodiment of a bit material according to the present invention steel comprising:

0.12 wt% C, 0.45 wt% Si, 0.50 wt% Mn, 3.3 wt% Cr, 1.6 wt% Mo, 0.30 wt% V, the balance being Fe was adopted, from which a bit was manufactured with the application of a carburising treatment. After being held for 2 hours in a high temperature environment of 400° C. together with conventional bits made of carburizing steel according to SAE 4620 and 4815, they were cooled to measure the hardness pattern of the surface layer. The results of the measurements are shown in FIG. 3, and the results of similar measurements carried out at room temperature on bits not subjected to the high temperature environment are shown in FIG. 4.

Figure 3:
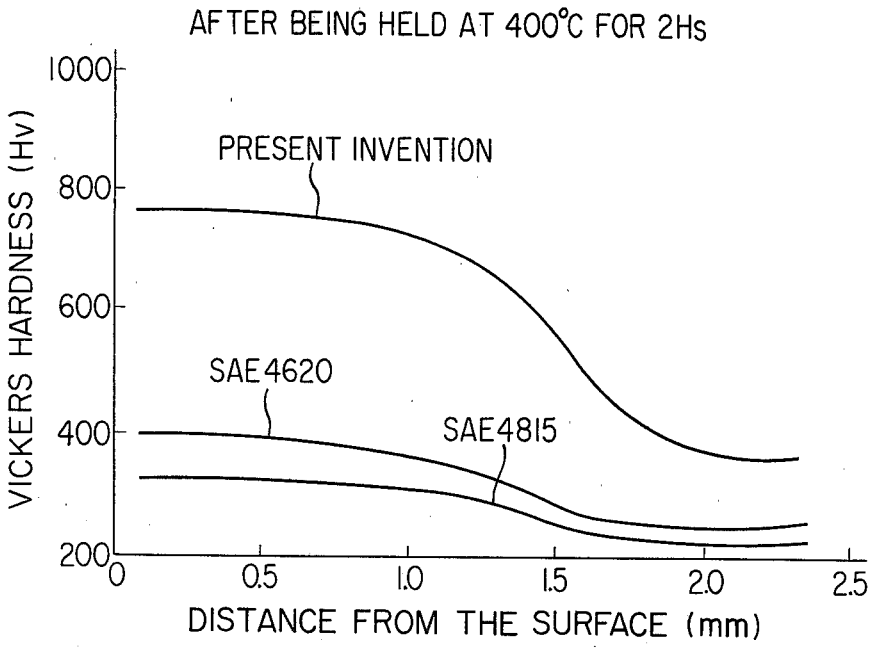
FIGS. 3 and 4 are diagrams showing the hardness distributions of a bit material according to the present invention and the conventional bit materials after they are held at high temperature and at room temperature, respectively.
Figure 4:
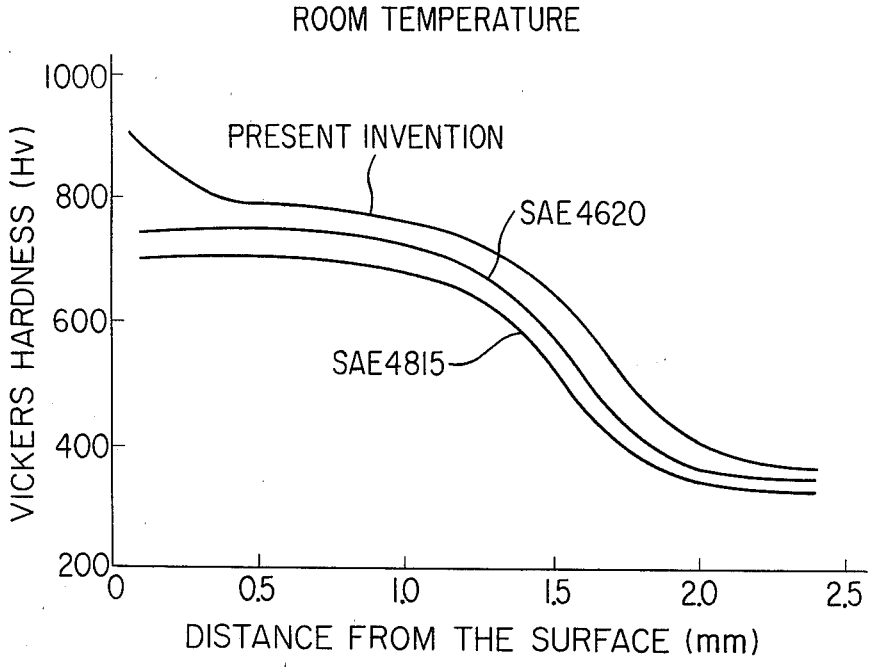

When FIGS. 3 and 4 are compared it will be understood that the bit material according to the present invention, compared with the conventional bit materials (i.e. carburizing steel according to SAE 4620 and 4815), has a higher degree of hardness of the surface layer, and, it exhibits excellent heat resistivity, being capable of maintaining a hardness level above 700 on the Vickers scale, even after being held for 2 hours at a temperature of 400° C., whereas, the conventional bit materials entirely lose their heat resistivity, the hardness level falling below 400 on the Vickers scale after subjected to a similar heating condition.

Further, the bits made of a bit material according to the present invention as well as the bits made of the conventional carburizing steel were tested at a temperature of 400° C. for 4 hours under the conditions of a bit load of 10$^t$ and a rotation of 60 rpm to investigate the wear of the various parts, the results being listed in Table I.

TABLE I

| | Conventional Carburizing Bit Steel | Bit Material according to Present Invention |
|---|---|---|
| Wear of Race of Cutter (mm) | 0.68 | 0.12 |
| Wear of Race of Bit Leg (mm) | 1.4 | 0.27 |

From Table I, it will be understood that the bit material according to the present invention is superior also in wear resistivity as compared to the conventional carburing steel bit.

If one considers a cutter with an insert type bit wherein cutting teeth made of hard metal such as tungalloy are embedded in the cutter cone made of a bit material, during actual drilling, the cutting teeth are subjected to a twisting action, a bending action, etc. Therefore, the dynamic insert retention of the bit material with regard to the hard metal chips is thought to depend upon the hardness of the base material at the surface of a hole within which the chip is received, in particular near the surface of the hole, rather than the press fit ratio. However, in the conventional bit materials (i.e. carburizing steel according to SAE 4620 and 4815), as apparent from FIG. 3 which shows the results of tests after they have been held at a temperature of 400° C. for 2 hours, their core hardness decreases to 200 to 250 or below on the Vickers scale. In other words, the cutting teeth are merely held by the surface of a hole having a hardness of 200 to 250 or below on the Vickers scale. However, in recent insert type bits, it has been desired to sharpen the cutting tooth and increase its penetration rate to the portion embedded in the cutter cone, somewhat, with the object of enabling use over an intrinsically long period of time at the same time as increasing the drilling performance, so that it is often the case that slackening and twisting of the chip are produced by strong impacts, and the twisting and bending actions, etc. to which, for the reasons above explained, the cutter teeth is subjected during drilling, and, in extreme cases, the chip itself falls out of the cutter cone, remarkably affecting in the life of the bit.

In view of such drawbacks in the conventional bit materials, in order to confirm the effectiveness of the bit material according to the present invention, insert type bits were prepared using the material of the present invention, comprising 0.17 wt% C, 0.35 wt% Si, 0.57 wt% Mn, 3.8 wt% Cr, 1.05 wt% Mo, 0.40 wt% V, the balance being Fe, and the materials according to SAE 4620 and 4815, and then after the materials had been carburized and quenched, the insert type bits were fitted under pressure in a cutter cone. The bits thus prepared were tested to investigate the insert retention for the cutting teeth when heated to a temperature of 400° C. In this case, the insert retention for the cutting tooth was determined by measuring the pressure at which the cutting tooth was thrust out from the cutter cone when pushed by a hydraulic cylinder. The results are shown in Table II.

TABLE II

| | Thrusting Out Pressure of Cutting Tooth (t) | | |
|---|---|---|---|
| Test Temperature (°C.) | Bit Material of Present Invention | Carburizing Bit Steel of SAE 4620 | Carburizing Bit Steel of SAE 4815 |
| Room Temperature | 3.9 | 3.3 | 3.5 |
| 300 | 3.6 | 0.58 | 0.6 |
| 400 | 3.2 | 0.06 | 0.06 |

From Table II it will be understood that in contrast with the conventional carburizing bit materials which show a sharp decrease in the insert retension for the cutting tooth, with an insert type bit using the bit material according to the present invention, an insert retention that makes it adequately possible to use the bit in a high temperature state of 400° C., is ensured.

From the foregoing it will be appreciated that in accordance with the present invention a bit material is provided that is suitable for use after carburization, and which exhibits outstanding resistance to wear, impact and heat, temperature, when used as a bit material in general use and at high temperature.

What is claimed is:

1. A material for a bit for drilling igneous rock having a bit leg, cutters rotatably mounted in said bit leg, bearing means interposed between said cutters and said bit leg, and ring seals arranged in said cutters near bearings, whereby said cutter is peripherally provided with cutting teeth either formed integrally therewith or separately by embedding therein cutting teeth made of hard metal such as tungalloy, said material to be used for said bit leg, said cutter, said bearing, said ring seal, etc. being steel consisting essentially of 0.10 to 0.20 wt% C, up to 0.5 wt% of Si, up to 1.0 wt% Mn, 3.0 to 5.0 wt% Cr, 0.8 to 2.0 wt% Mo, 0.10 to 0.70 wt% V, the balance being Fe, and adapted to be used after its surface layer is hardened by a carburizing process.

* * * * *